US012781486B2

(12) United States Patent
Smith et al.

(10) Patent No.: US 12,781,486 B2
(45) Date of Patent: Nov. 3, 2026

(54) HAND WASHING STATION

(71) Applicant: Stone And Steel Systems, LLC, Mesa, AZ (US)

(72) Inventors: James K. Smith, Phoneiz, AZ (US); Austin Davis, Phoenix, AZ (US); Steven Kueffer, Mesa, AZ (US); Kevin Roe, Phoenix, AZ (US); Kay Herbert, Winthrop, MA (US)

(73) Assignee: Stone And Steel Systems, LLC, Mesa, AZ (US)

( * ) Notice: Subject to any disclaimer, the term of this patent is extended or adjusted under 35 U.S.C. 154(b) by 150 days.

(21) Appl. No.: 18/655,955

(22) Filed: May 6, 2024

(65) Prior Publication Data

US 2024/0368869 A1 Nov. 7, 2024

Related U.S. Application Data

(60) Provisional application No. 63/464,179, filed on May 4, 2023.

(51) Int. Cl.
*E03C 1/182* (2006.01)
*E03C 1/14* (2006.01)

(52) U.S. Cl.
CPC ..... *E03C 1/182* (2013.01); *E03C 1/14* (2013.01); *A47K 2210/00* (2013.01)

(58) Field of Classification Search
CPC ..... E03C 1/12; E03C 1/14; E03C 1/16; E03C 1/18; E03C 1/182; A47K 2210/00;
(Continued)

(56) References Cited

U.S. PATENT DOCUMENTS 2,270,606 A * 1/1942 Rotter ..... E03C 1/182 4/615
6,014,780 A * 1/2000 Jurek ..... A47K 3/283 4/613

(Continued)

FOREIGN PATENT DOCUMENTS

CA 2873015 A1 9/2013
DE 3347870 A1 9/1985

(Continued)

OTHER PUBLICATIONS

Jul. 31, 2024—(WO) ISR and Written Opinion—App PCT/US2024/028022.

(Continued)

*Primary Examiner* — Erin Deery
(74) *Attorney, Agent, or Firm* — Banner & Witcoff, Ltd.

(57) ABSTRACT

A hand washing station includes a basin assembly having a rear configured for mounting to a wall surface and a front opposite the rear. The basin assembly includes a basin having a trough positioned proximate to the rear of the basin assembly and recessed from an adjacent surface of the basin located forward of the trough, with the trough having a front wall extending downward from the adjacent surface and a bottom wall extending rearward from the front wall. The basin assembly also includes a drain within the trough, formed by a slot extending through the front wall. A drain adapter is mounted on the trough below the basin and includes a passage in communication with the drain and extending through the drain adapter to an outlet for connection to a drain pipe, where the drain adapter receives water exiting the drain and outputs the water to the drain pipe.

23 Claims, 14 Drawing Sheets

(58) Field of Classification Search
CPC ... A47K 1/00; A47K 1/02; A47K 1/04; A47K 1/12; A47K 3/40
See application file for complete search history.

(56) References Cited

U.S. PATENT DOCUMENTS

| | | | | |
|---|---|---|---|---|
| 6,618,874 | B2 * | 9/2003 | Gerloff | E03C 1/18 4/619 |
| D582,528 | S | 12/2008 | Gallob | |
| D603,486 | S | 11/2009 | Mayer et al. | |
| D745,120 | S * | 12/2015 | Adkison | D23/284 |
| 9,739,045 | B1 | 8/2017 | Jones | |
| D797,264 | S | 9/2017 | Gallob | |
| 9,877,620 | B2 * | 1/2018 | Gallob | E03C 1/0404 |
| D823,445 | S | 7/2018 | Adkison | |
| 10,041,236 | B2 | 8/2018 | Loberger et al. | |
| D840,005 | S | 2/2019 | Wieser et al. | |
| D901,645 | S | 11/2020 | Bayless et al. | |
| 11,047,119 | B2 | 6/2021 | Gallob | |
| 11,180,909 | B2 | 11/2021 | Brockmeyer | |
| D939,064 | S | 12/2021 | Doubet et al. | |
| 11,542,692 | B2 | 1/2023 | Loberger et al. | |
| 11,896,171 | B2 * | 2/2024 | Gallob | E03C 1/186 |
| 12,065,814 | B2 | 8/2024 | Gallob | |
| D1,049,327 | S | 10/2024 | Ren | |
| D1,107,192 | S | 12/2025 | Khubani et al. | |
| D1,108,586 | S | 1/2026 | Liu | |
| D1,117,662 | S | 3/2026 | Roden et al. | |
| D1,118,848 | S | 3/2026 | Roden et al. | |
| D1,118,849 | S | 3/2026 | Noh | |
| D1,118,850 | S | 3/2026 | Roden et al. | |
| 2003/0046758 | A1 | 3/2003 | Gerloff | |
| 2010/0251477 | A1 | 10/2010 | Bates | |
| 2011/0271441 | A1 | 11/2011 | Bayley et al. | |
| 2015/0074899 | A1 | 3/2015 | Gallob | |
| 2015/0376881 | A1 | 12/2015 | Moe | |
| 2016/0326732 | A1 | 11/2016 | McCormick | |
| 2017/0356173 | A1 | 12/2017 | Loberger et al. | |
| 2020/0046172 | A1 | 2/2020 | Loberger et al. | |
| 2021/0321835 | A1 * | 10/2021 | Gallob | E03C 1/186 |
| 2024/0344310 | A1 | 10/2024 | Gallob et al. | |
| 2024/0368869 | A1 | 11/2024 | Smith et al. | |
| 2026/0022551 | A1 | 1/2026 | Shen | |

FOREIGN PATENT DOCUMENTS

| | | | |
|---|---|---|---|
| DE | 4239868 | C1 | 3/1994 |
| DE | 9319156 | U1 | 3/1994 |
| DE | 102008044637 | A1 | 10/2009 |
| EP | 0637651 | A1 | 2/1995 |
| EP | 1367185 | A1 | 12/2003 |
| ES | 2299295 | A1 | 5/2008 |
| GB | 2459030 | A | 10/2009 |
| JP | S5716532 | U | 1/1982 |
| JP | S6048525 | U | 4/1985 |
| KR | 200195584 | Y1 | 9/2000 |
| WO | 2010123774 | A1 | 10/2010 |
| WO | 2017201192 | A1 | 11/2017 |
| WO | 2019241270 | A1 | 12/2019 |

OTHER PUBLICATIONS

Amazon, GESIPOR Resin Sink, posted May 31, 2023, [online], [visited Jan. 23, 2025]. Internet, <URL: https://www.amazon.com/GESIPOR-Wall-Mount-Bathroom-Rectangular-Floating/dp/B0C6Q851K8?th=1> (Year: 2023).

Amazon, Davivy Wall Mounted Sink, posted May 27, 2024, [online], [visited Jan. 23, 2025]. Internet, <URL: https://www.amazon.com/Davivy-Rectangle-Installation-Bathroom-Bathrooms/dp/B0D596MSPH?th=1> (Year: 2024).

Amazon, Eridanus Bathroom Vessel Sink, posted Dec. 28, 2023, [online], [visited Jan. 23, 2025]. Internet, <URL: https://www.amazon.com/Eridanus-Bathroom-Floating-Rectangular-Washbasin/dp/BOC L5YGL18/ref?th= 1> (Year: 2023).

* cited by examiner

HAND WASHING STATION

CROSS-REFERENCE TO RELATED APPLICATION

This application is a nonprovisional of, and claims priority to, U.S. Provisional Application No. 63/464,179, filed May 4, 2023, the entire disclosure of which is incorporated by reference herein.

TECHNICAL FIELD

This disclosure relates to hand washing stations such as sinks, and more specifically to sinks configured for a wall mount configuration, which may include multiple integrated functions, such as water dispensing, soap dispensing, and hand drying.

BACKGROUND

Numerous different types of sinks and other hand washing stations exist, including integrated sinks that include a water dispenser, a soap dispenser, and a hand dryer. Such sinks suffer from many problems and drawbacks, particularly when installed in public restrooms. For example, such sinks may present difficulties in installation and servicing. As another example, such sinks may not have sufficient room for installation of large components, such as large-capacity soap supply containers. As a further example, such sinks may have drain pipe connections that require excessive space and are difficult to clean.

The present disclosure is provided to address this need and other needs in existing sinks and other hand washing stations. A full discussion of the features and advantages of the present invention is deferred to the following detailed description, which proceeds with reference to the accompanying drawings.

BRIEF SUMMARY

Aspects of the disclosure relate to a hand washing station including a basin assembly having a rear configured for mounting to a wall surface and a front opposite the rear. The basin assembly includes a shelf at a top of the basin assembly and extending across the front of the basin assembly, and a basin extending below the shelf having a front sloping surface having a front end located proximate to the front and the top of the basin assembly and extending rearward and downward from the front end to a rear end. The basin also includes a trough located at the rear end of the front sloping surface, and a rear wall extending upward from the trough to the rear and the top of the basin assembly, and the trough has a front wall extending downward from the rear end of the front sloping surface and a bottom wall extending rearward from the front wall. The basin assembly further includes a drain within the trough formed by a slot extending through the front wall. A drain adapter is mounted on an outer surface of the front wall of the trough below the basin, the drain adapter having a recess in communication with the drain and a passage extending from the recess through the drain adapter to an outlet configured for connection to a drain pipe. The drain adapter is configured to receive water exiting the basin through the drain into the recess and to output the water to the drain pipe.

According to one aspect, the basin has two opposed side walls extending downward on opposite sides of the basin assembly and intersecting with the rear wall, the trough, and the front sloping surface, and wherein the trough extends an entire width of the basin between the opposed side walls.

According to another aspect, the rear wall is a planar wall extending from the top of the basin assembly to the bottom wall of the trough.

According to a further aspect, the shelf further extends around an entire periphery of the basin, along opposed sides of the basin assembly and along the rear of the basin assembly. In one aspect, the hand washing station also includes a water dispenser having a water spout mounted on the shelf at the rear of the basin assembly and configured to dispense water through the water spout into the basin. In another aspect, the hand washing station further includes a soap dispenser having a soap spout mounted on the shelf at the rear of the basin assembly and configured to dispense soap through the soap spout, and a hand dryer having an air spout mounted on the shelf at the rear of the basin assembly and configured to force heated air through the air spout.

According to yet another aspect, the drain adapter further includes a base engaged with the bottom wall of the trough and extending rearward along the outer surface of the bottom wall, and an arm engaged with the front wall of the trough and extending upward from the base along the outer surface of the front wall. In one aspect, the recess of the drain adapter is defined in the arm and the base, and the passage extends from the recess through the base of the drain adapter to the outlet.

According to a still further aspect, the drain is located between opposed ends of the trough, and the bottom wall of the trough is sloped downward and toward the drain from both of the opposed ends.

According to an additional aspect, the hand washing station further includes a hand dryer configured to force heated air into the basin, and a vent located between the front end of the front sloping surface and the shelf, wherein the front sloping surface is configured to direct the heated air into the vent.

Additional aspects of the disclosure relate to a hand washing station including a basin assembly having a rear configured for mounting to a wall surface and a front opposite the rear. The basin assembly includes a basin having a trough positioned proximate to the rear of the basin assembly and recessed from an adjacent surface of the basin located forward of the trough, with the trough having a front wall extending downward from the adjacent surface and a bottom wall extending rearward from the front wall. The basin assembly also includes a drain within the trough, formed by a slot extending through the front wall. A drain adapter is mounted on the trough and engaged with outer surfaces of the front wall and the bottom wall of the trough below the basin. The drain adapter includes a base and an arm extending upward from the base, the base having a horizontal engagement surface engaged with the bottom wall of the trough and extending rearward along the outer surface of the bottom wall, and the arm having a vertical engagement surface engaged with the front wall of the trough and extending upward along the outer surface of the front wall. The drain adapter further includes a recess defined in the horizontal engagement surface and the vertical engagement surface and a passage extending from the recess through the drain adapter to an outlet configured for connection to a drain pipe, where the drain adapter is mounted to place the recess in communication with the drain, such that the recess is configured to receive water exiting the basin through the drain and to output the water to the drain pipe.

According to one aspect, the basin has two opposed side walls extending downward on opposite sides of the basin, and the trough extends an entire width of the basin between the opposed side walls.

According to another aspect, the basin further has a rear wall having a sloped, planar surface extending from a top of the basin assembly to the bottom wall of the trough.

According to a further aspect, the basin assembly further includes a shelf at the top of the basin assembly and extending around an entire periphery of the basin, along the front and the rear of the basin assembly and along opposed sides of the basin assembly, where the basin extends below the shelf. In one aspect, the hand washing station further includes a water dispenser comprising a water spout mounted on the shelf at the rear of the basin assembly and configured to dispense water through the water spout into the basin, a soap dispenser comprising a soap spout mounted on the shelf at the rear of the basin assembly and configured to dispense soap through the soap spout, and a hand dryer having an air spout mounted on the shelf at the rear of the basin assembly and configured to force heated air through the air spout.

According to yet another aspect, the drain is located between opposed ends of the trough, and the bottom wall of the trough is sloped downward and toward the drain from both of the opposed ends.

Further aspects of the disclosure relate to a hand washing station including a basin assembly having a rear configured for mounting to a wall surface and a front opposite the rear. The basin assembly has a front shelf extending across the front of the basin assembly at a top of the basin assembly, a rear shelf at the top of the basin assembly and extending across the rear of the basin assembly, and a basin extending below the front shelf and the rear shelf and having a trough positioned proximate to the rear of the basin assembly and recessed from an adjacent surface of the basin located forward of the trough. The trough has a front wall extending downward from the adjacent surface and a bottom wall extending rearward from the front wall. The basin assembly further includes a drain within the trough formed by a slot extending through the front wall. The hand washing station also includes a water dispenser having a water spout mounted on the rear shelf and configured to dispense water through the water spout into the basin, a soap dispenser having a soap spout mounted on the rear shelf and configured to dispense soap through the soap spout, and a hand dryer having an air spout mounted on the rear shelf and configured to force heated air through the air spout. The hand washing station further includes a drain adapter mounted on an outer surface of the front wall of the trough below the basin, the drain adapter including a passage in communication with the drain and extending through the drain adapter to an outlet configured for connection to a drain pipe. The drain adapter is configured to receive water exiting the basin through the drain and to output the water to the drain pipe.

According to one aspect, the basin assembly further includes a vent located below the shelf at the front of the basin assembly, wherein the basin has an inclined surface configured to direct the heated air into the vent.

According to another aspect, the basin has two opposed side walls extending downward on opposite sides of the basin assembly and intersecting with the trough, and the trough extends an entire width of the basin between the opposed side walls.

According to a further aspect, the basin has a rear wall having a sloped, planar surface extending from the rear shelf to the bottom wall of the trough.

According to yet another aspect, the drain adapter also includes a base engaged with the bottom wall of the trough and extending rearward along the outer surface of the bottom wall, and an arm engaged with the front wall of the trough and extending upward from the base along the outer surface of the front wall. In one aspect, the drain adapter further includes a recess defined in the arm and/or the base and a passage extending from the recess through the drain adapter to an outlet configured for connection to a drain pipe. The drain adapter is mounted to place the recess in communication with the drain, such that the recess is configured to receive the water exiting the basin through the drain and to output the water to the drain pipe.

According to a still further aspect, the drain is located between opposed ends of the trough, and the bottom wall of the trough is sloped downward and toward the drain from both of the opposed ends.

Other aspects of the disclosure relate to a method of assembling a hand washing station, including mounting a drain adapter on an outer surface of a trough, to cover the drain opening, by connecting the drain adapter to at least a front wall of the trough.

Other features and advantages of the disclosure will be apparent from the following description taken in conjunction with the attached drawings.

BRIEF DESCRIPTION OF THE DRAWINGS

To allow for a more full understanding of the present disclosure, it will now be described by way of example, with reference to the accompanying drawings in which.

DETAILED DESCRIPTION

Figure 1:
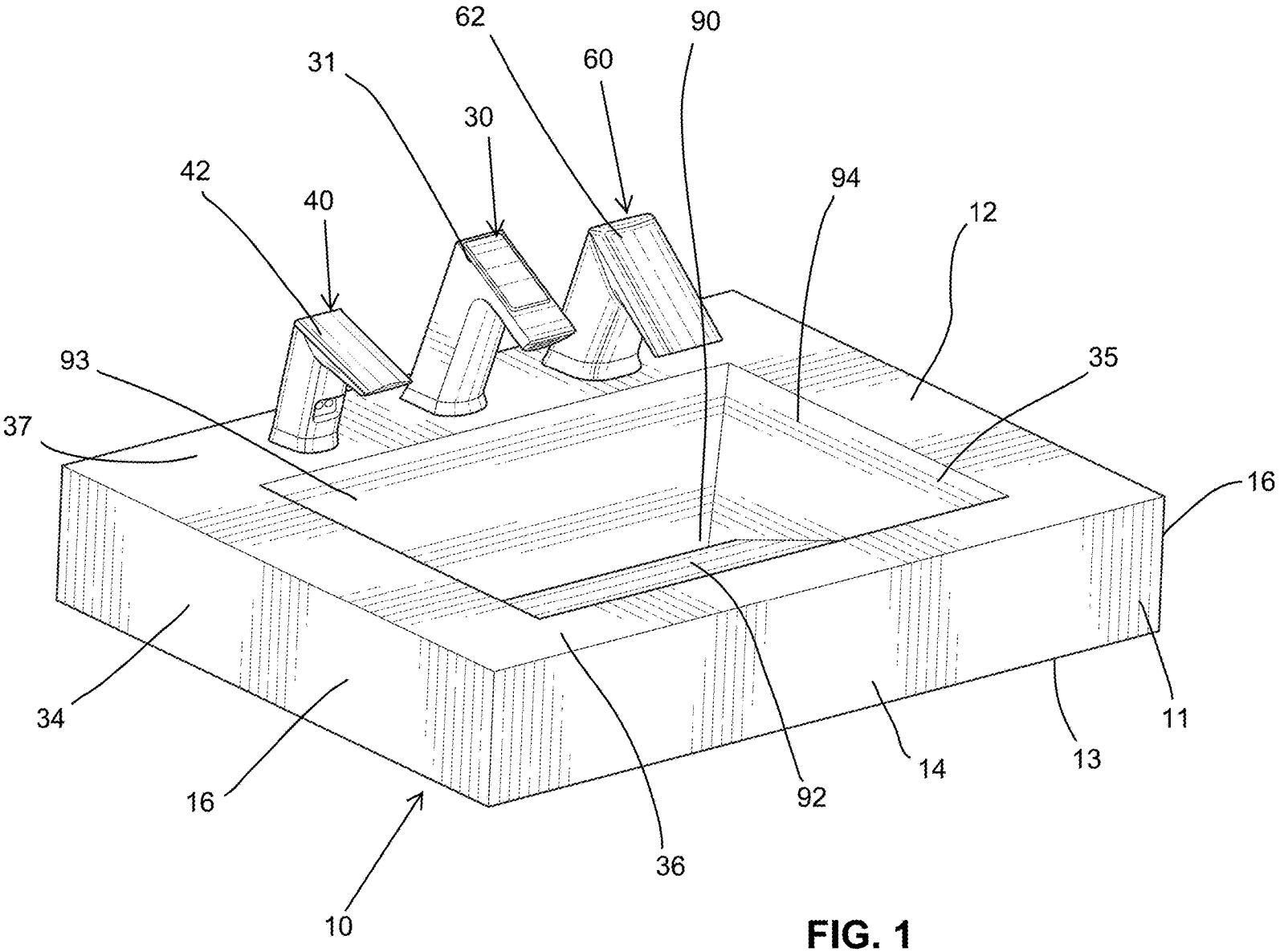
FIG. 1 is a perspective view of one embodiment of a hand washing station according to aspects of the disclosure, installed in a first wall configuration.
Figure 2:
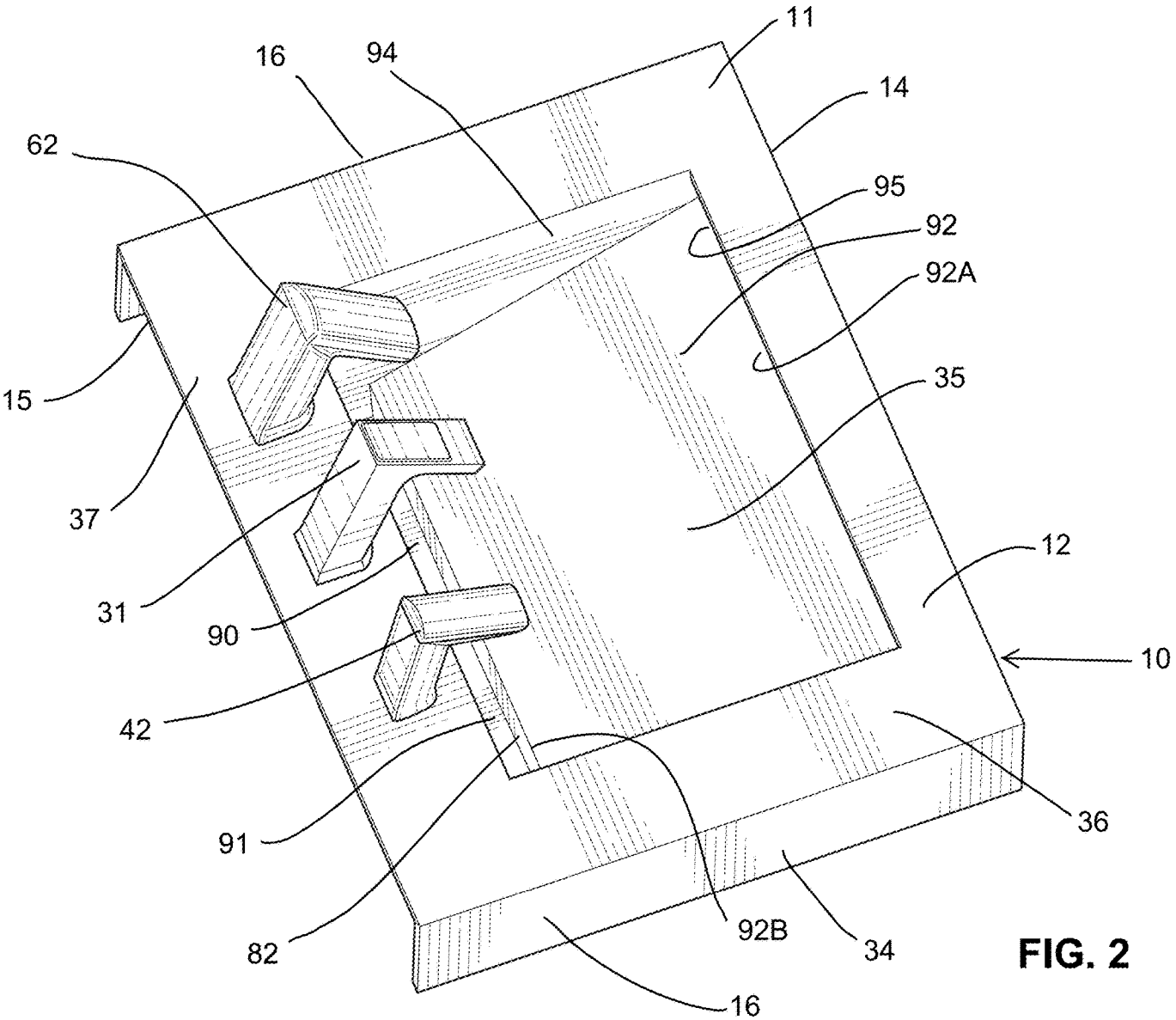
FIG. 2 is a perspective view of the hand washing station of FIG. 1.
Figure 3:
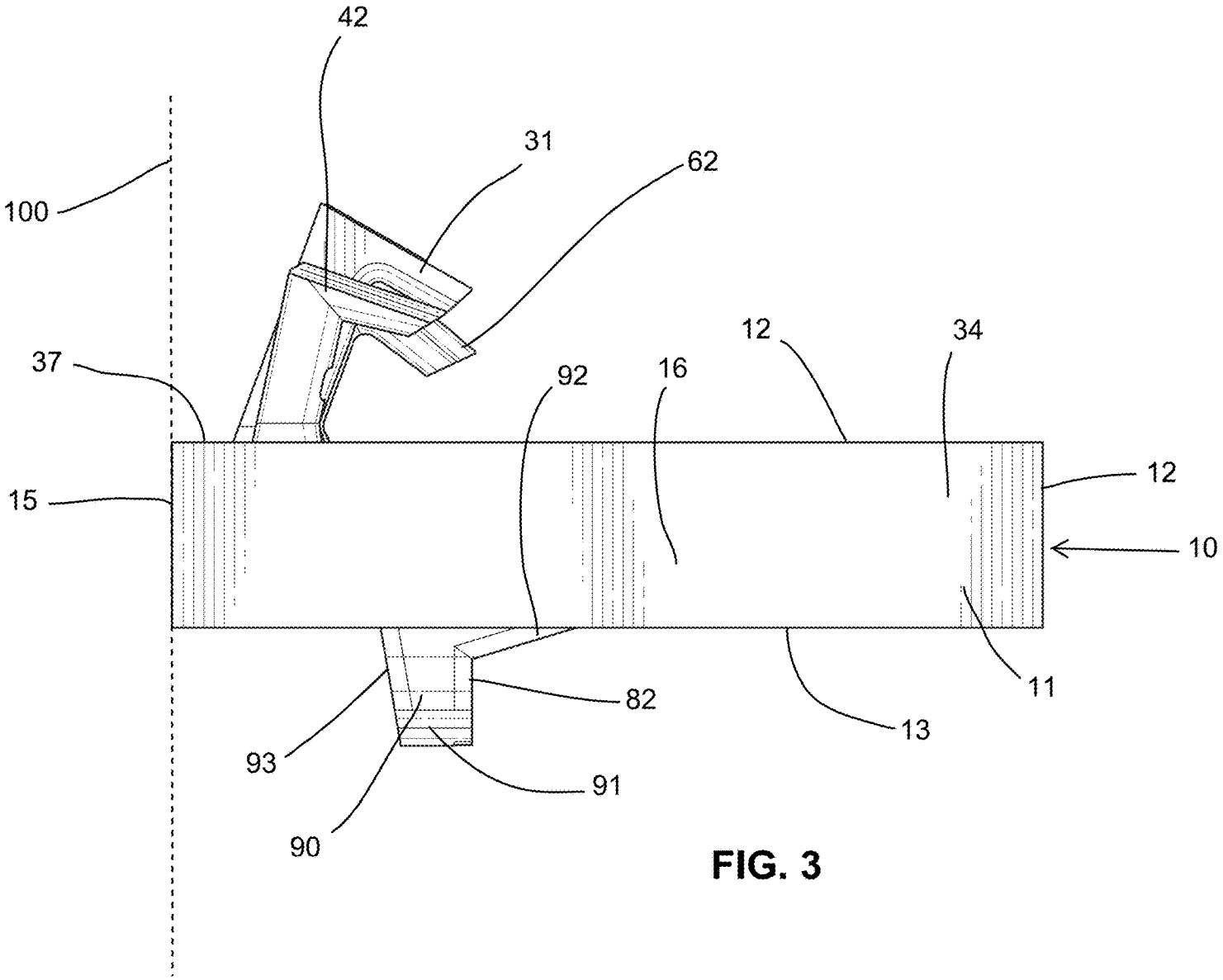
FIG. 3 is a side view of the hand washing station of FIG. 1.
Figure 4:
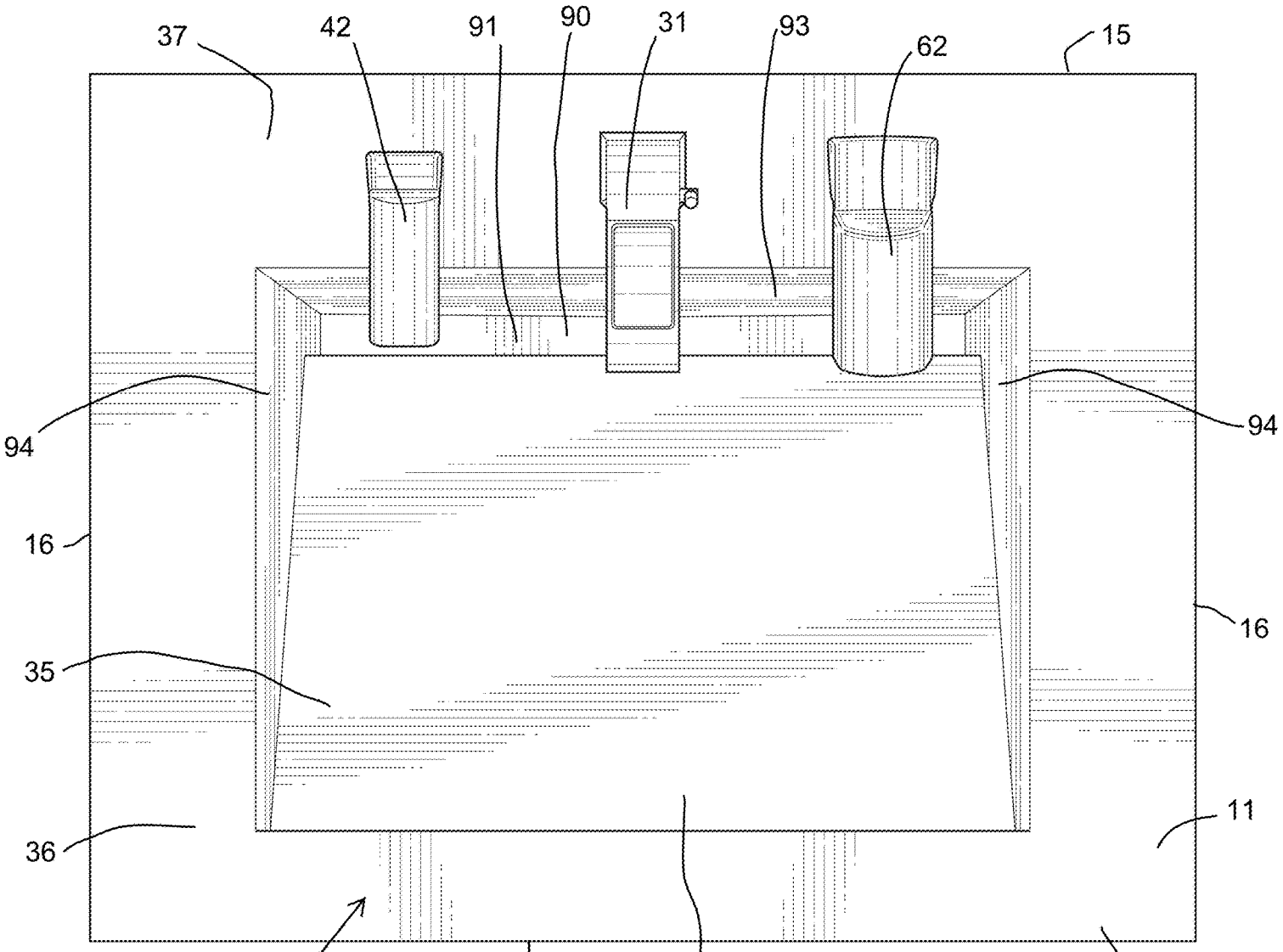
FIG. 4 is a top view of the hand washing station of FIG. 1.

While this invention is susceptible of embodiments in many different forms, there are shown in the drawings and will herein be described in detail example embodiments of the invention with the understanding that the present disclosure is to be considered as an exemplification of the principles of the invention and is not intended to limit the broad aspect of the invention to the embodiments illustrated. In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

Referring to the figures, and initially to FIGS. 1-11, there is shown one embodiment of a hand washing station, identified by reference numeral 10. In various embodiments, the hand washing station 10 may include one or more of a basin assembly 11, a water dispenser assembly or water dispenser 30, a soap dispenser assembly or soap dispenser 40, a hand dryer assembly or hand dryer 60, and a drain adapter assembly 70 connected to a drain 17 of the basin assembly 11. The hand washing station 10 in FIGS. 1-11 is provided as an integrated sink that includes all of these features. Various additional components and embodiments are described herein. The basin assembly 11 generally has a top 12, a bottom 13 opposite the top 12, a front 14, a rear 15 opposite the front 14, and opposed left and right sides 16, and includes a basin 35, a shelf or front shelf 36 extending outward from the basin 35 along the front 14 and/or the sides 16 of the basin assembly 11, a rear shelf 37 extending from the basin 35 to the rear 15 of the basin assembly 11, and an apron 34 depending from the shelf 36 along the front 14 and/or the sides 16 of the basin assembly 11. The rear 15 of the basin assembly 11 can be mounted to a wall surface in various wall configurations. In the embodiment of FIGS. 1-11, the shelf 36 and the rear shelf 37 are part of a continuous shelf that extends around the entire periphery of the basin 35, across the front 14, the rear 15, and both sides 16.

The following directions and orientations will be used in describing components of the hand washing station 10 herein, with the understanding that these directions and orientations are illustrative with to the drawing figures shown and do not limit the embodiments in any way. The "vertical" direction is a top-to-bottom direction extending parallel to a wall surface 100 on which the hand washing station 10 is mounted and between the top 12 and the bottom 13 of the basin assembly 11. The "longitudinal" direction is a front-to-rear direction extending perpendicular to the wall surface 100 and between the front 14 and the rear 15 of the basin assembly 11. The "lateral" direction is a side-to-side direction extending parallel to the wall surface 100 and between the sides 16 of the basin.

The basin assembly 11 in FIGS. 1-11 has a plurality of sloped and contoured surfaces that define the shape of the basin assembly 11. It is noted that the term "sloped" as used herein does not itself imply that the respective surface is flat or planar, and a sloped surface may have a curved contour unless otherwise specified. The basin 35 has a trough 90 that extends laterally across the basin and has a bottom 91 with various contours that slope downward toward the drain 17 or drains 17 in the basin assembly 11. For example, the basin assembly 11 of FIGS. 1-11 includes a drain 17 along the lateral center plane of the basin 35, and the bottom 91 of the trough 90 slopes downwardly from the ends of the trough 90 toward the drain 17. In one embodiment, the trough 90 has a bottom wall 91 that includes two sections 80 that are sloped downward from the ends toward the drain 17, and the two sections 80 of the bottom wall 91 form a peak 81 at a lowermost point, proximate the drain 17. The drain 17 in the embodiment of FIGS. 1-11 is located in a front wall 82 of the trough 90 and is formed by a plurality of slots 83 through the front wall 82. It is understood that common materials may be used for the basin assembly 11, e.g., Corian. While seams are shown between the components of the basin assembly 11 in the figures, these are merely schematic in nature, as such seams would not be visible after the basin assembly 11 is installed.

The basin 35 includes a front sloping surface 92 extends from a front end 92A at or near the front 14 of the basin assembly 11 toward a rear end 92B at the trough 90, and slopes downward from the front end 92A to the rear end 92B, i.e., from the front 14 to the trough 90. The basin 35 also includes a rear wall 93 extends upward at the rear 15 of the basin assembly 11, and the trough 90 is located between the sloping surface 92 and the rear wall 93. In the embodiment of FIGS. 1-11, the front sloping surface 92 is a flat, planar surface that extends downward toward the trough 90 and extends to meet side walls 94 of the basin 35 that also depend downward into the basin assembly 11. The surfaces of the basin 35 may also direct the flow of air leaving the air output 62 so that the air flows up the front sloping surface 92 and to one or more vents 95 at the front 14 of the basin assembly 11. This vent configuration may be provided as described in U.S. Patent Application Publication No. 2015/0074899 A1, which is incorporated by reference herein in its entirety. As shown in FIGS. 8-9, the basin assembly 11 has a vent 95 on one side of the front 14 of the basin assembly 11 that runs only a portion of the lateral width of the basin front sloping surface 92. The vent(s) 95 may run the entire width of the basin assembly 11 in another embodiment. The configuration of the front sloping surface 92 directs the flow of air from the air output 62 to the vent(s) 95, and the configurations of the rear wall 93 and/or the side walls 94 may assist with this as well.

The side walls 94 in the embodiment of FIGS. 1-11 are slightly inwardly sloped from the top 12 toward the bottom 13 of the basin assembly 11. The side walls 94 in this embodiment extend from the underside of the shelf 36 to the front sloping surface 92 and the trough 90, and extend along the rear wall 93 as well, as shown in FIGS. 8-9. The slopes of the side walls 94 is illustrated in FIG. 9, and the side walls 94 form angles A with the vertical direction. The angles A are acute angles of up to 20°, such as a 15° angle in one embodiment. In another embodiment, the side walls 94 may be vertical. The trough 90 extends the entire width of the basin 35, between the two side walls 94.

Figure 7:
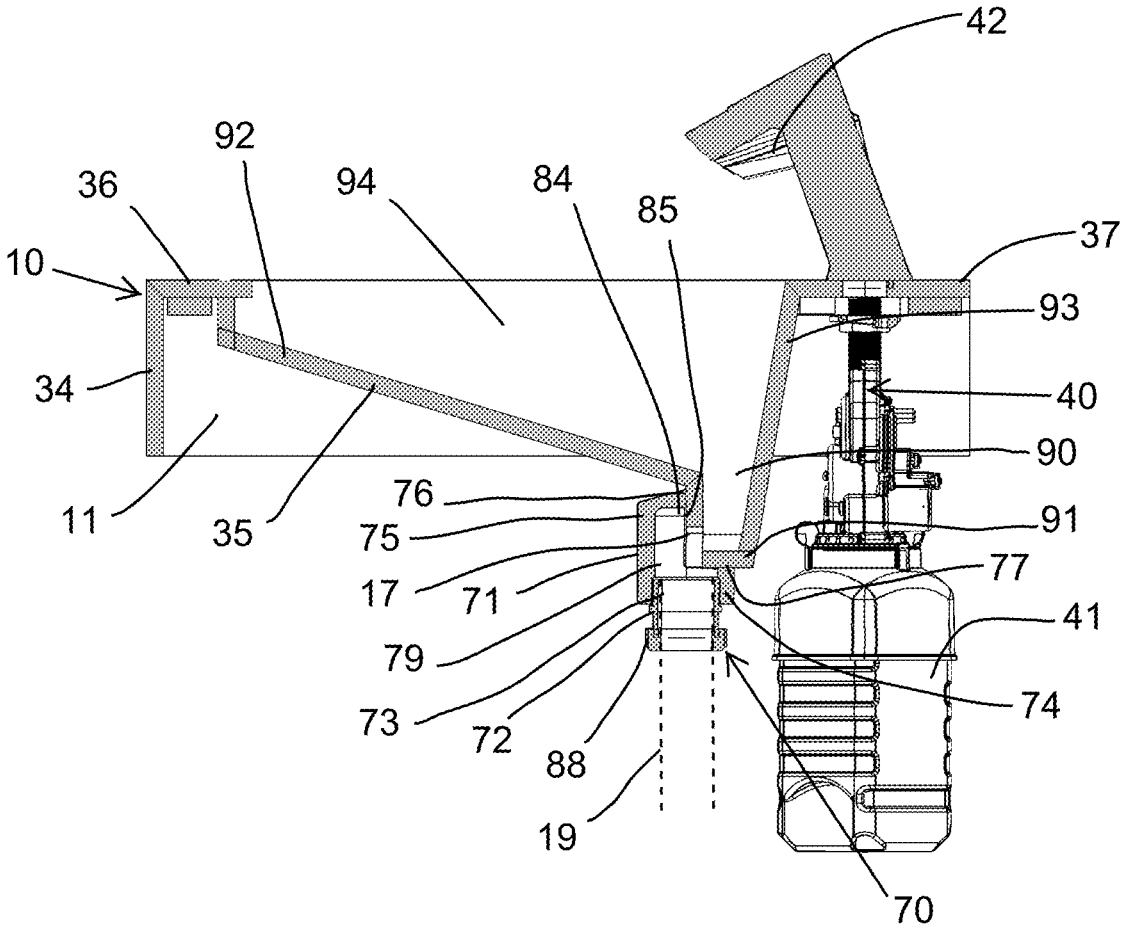
FIG. 7 is a cross-section view of the hand washing station of FIG. 1.
Figure 8:
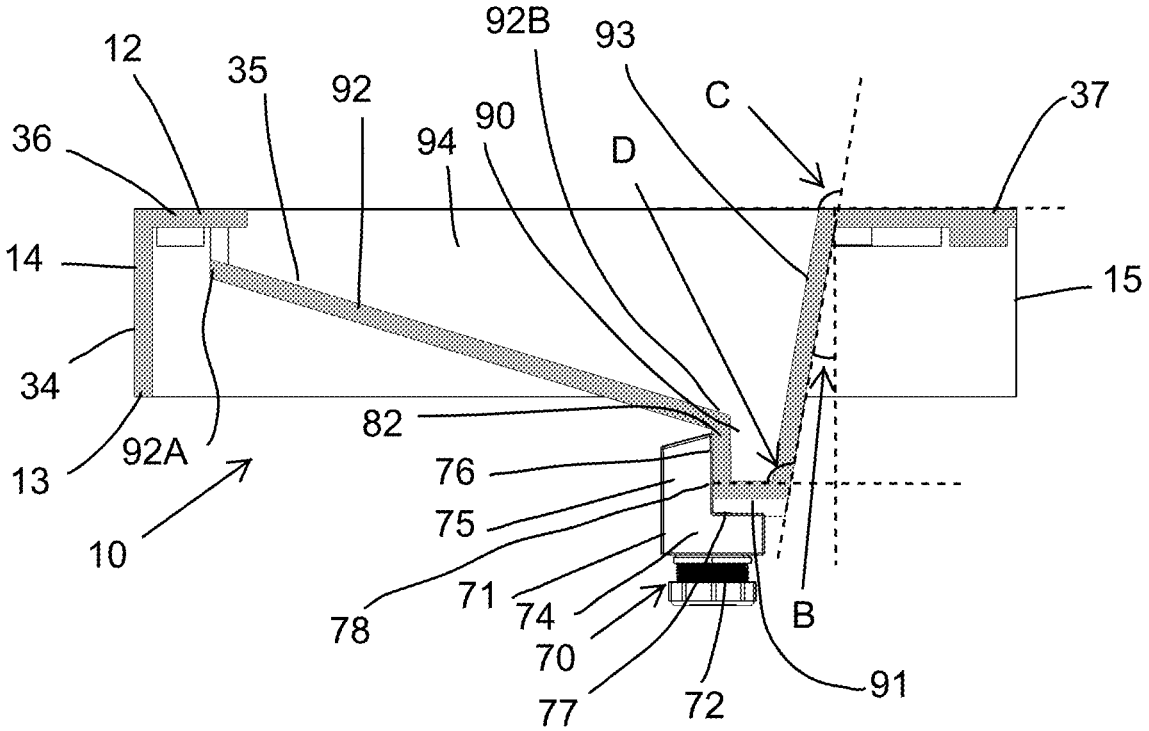
FIG. 8 is a cross-sectional view of a basin assembly of the hand washing station of FIG. 1.
Figure 9:
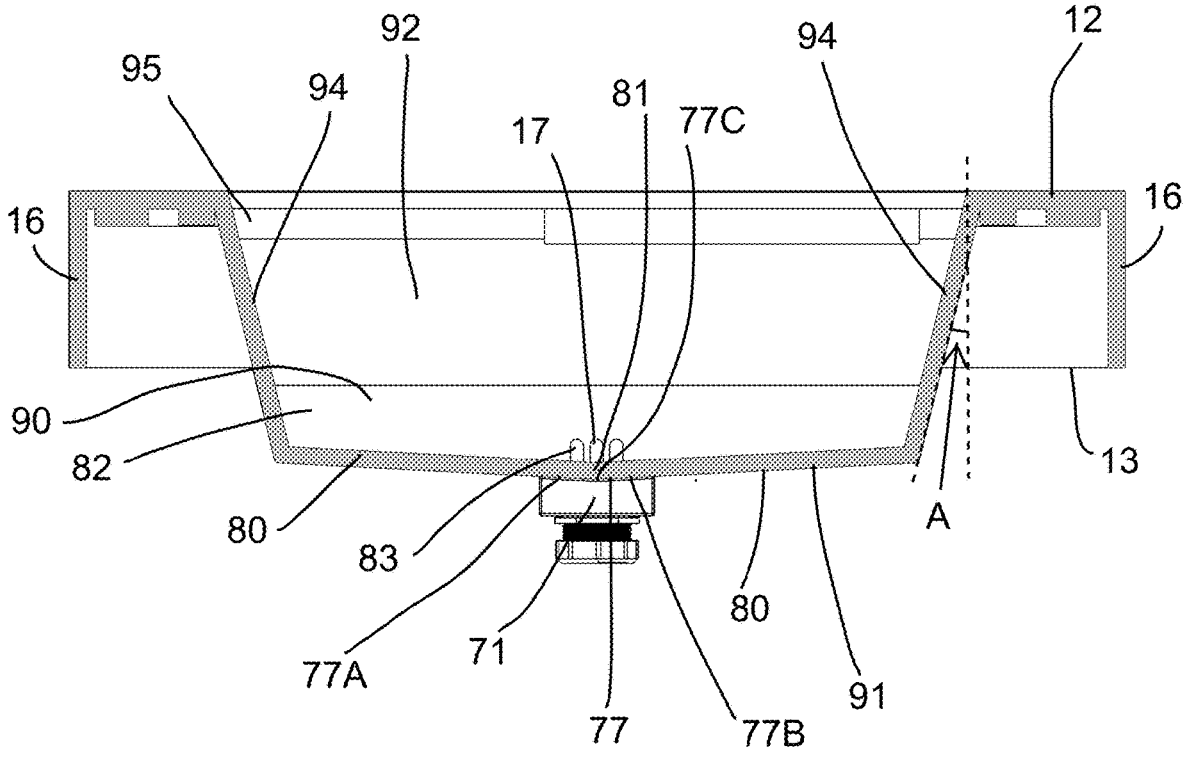
FIG. 9 is a cross-sectional view of the basin assembly of the hand washing station of FIG. 1.
Figure 10:
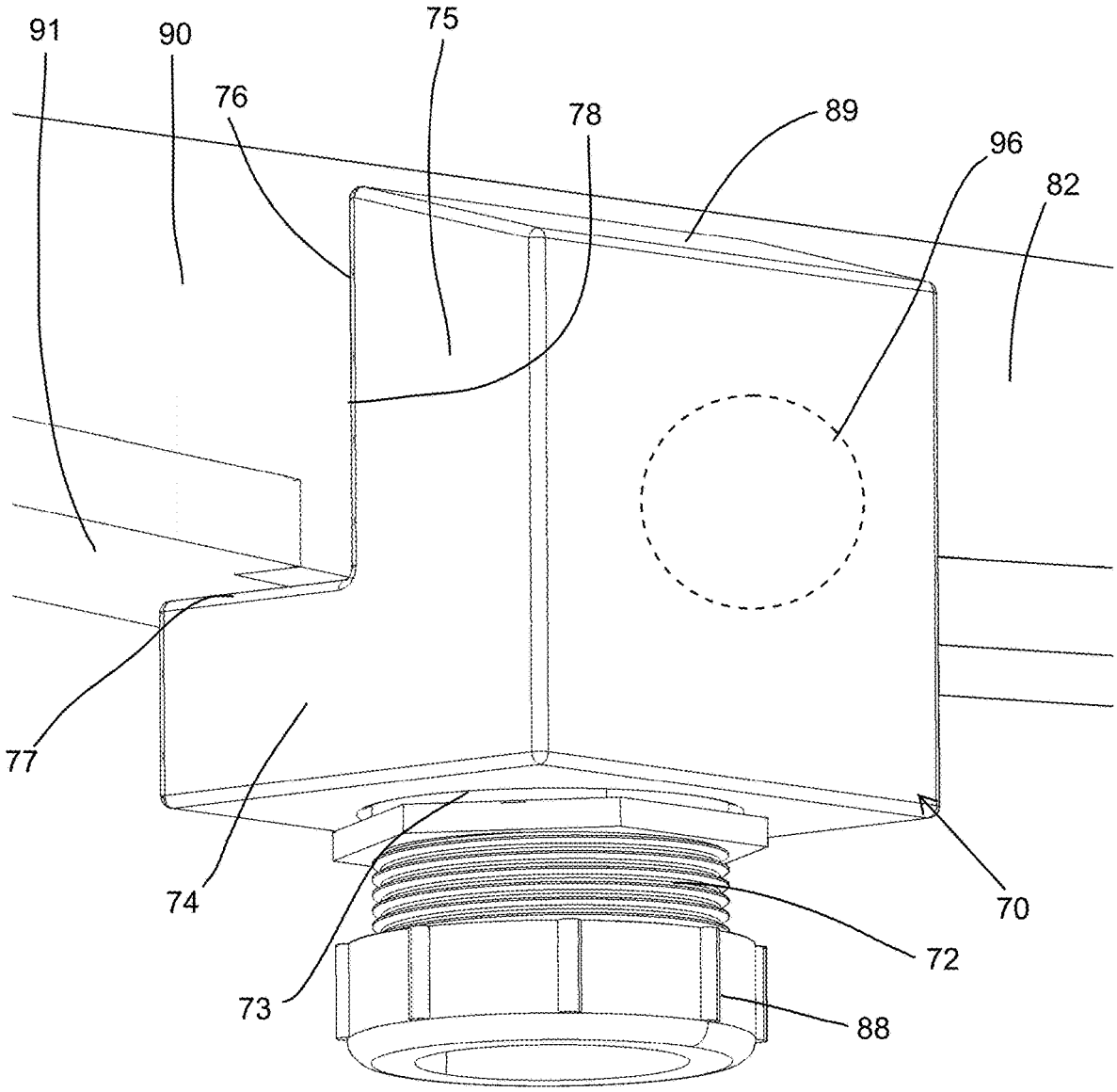
FIG. 10 is a magnified bottom perspective view of a portion of the hand washing station of FIG. 1.
Figure 11:
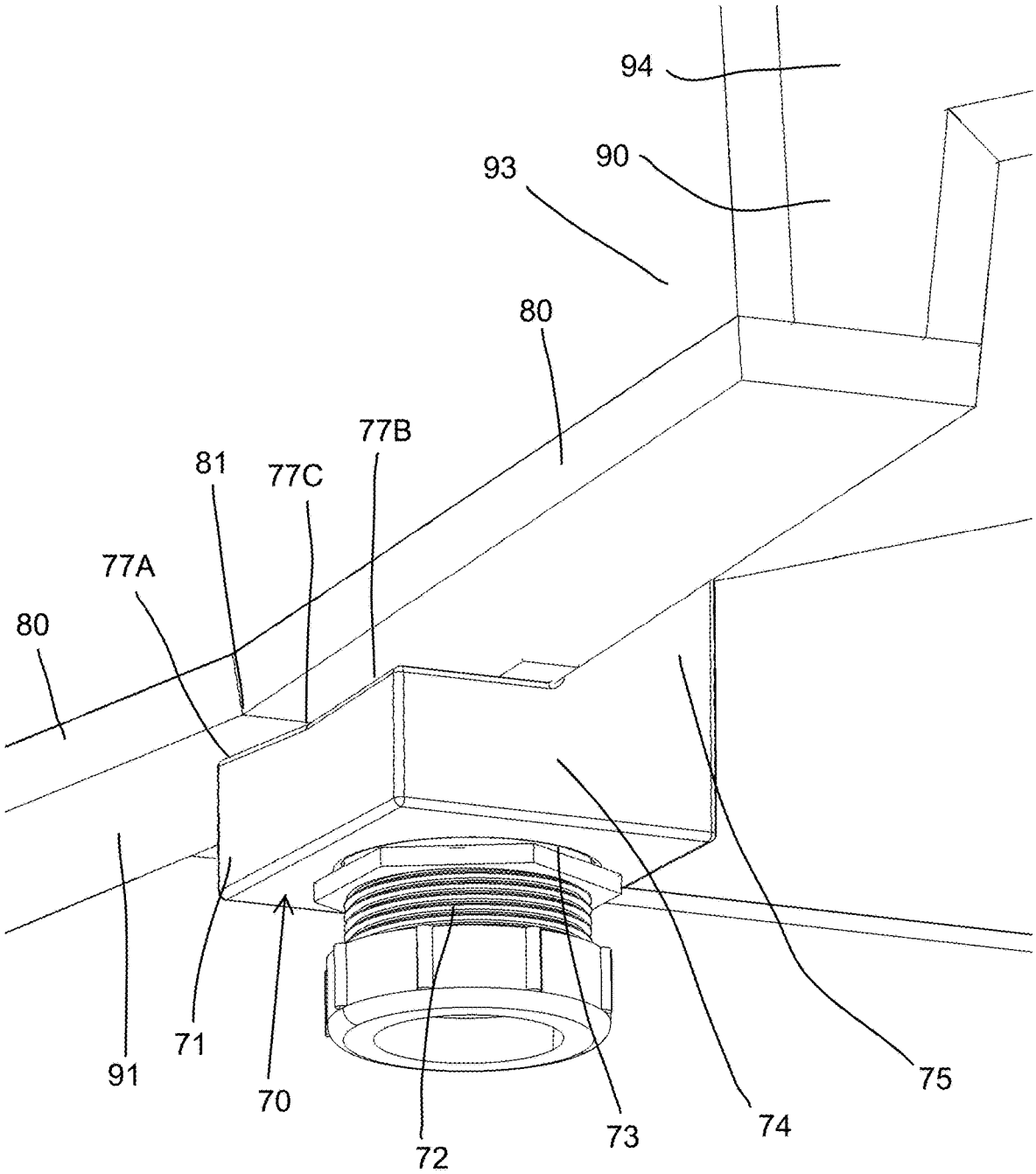
FIG. 11 is a magnified bottom perspective view of a portion of the hand washing station of FIG. 1.

The rear wall 93 in the embodiment of FIGS. 1-11 is inwardly sloped from the top 12 toward the bottom 13 of the basin assembly 11, and the rear wall 93 is substantially flat and planar in this embodiment. The rear wall 93 extends from the rear shelf 37 to the bottom wall 91 of the trough 90 and intersects the bottom wall 91 of the trough 90. The rear wall 93 forms an angle B with the vertical direction, an angle C with the rear shelf 37, and an angle D with the bottom wall 91 of the trough 90. The angle B in this embodiment is an acute angle of up to 15°, such as an angle of 10°. The angle C in this embodiment is an obtuse angle between 90° and 105°, such as an angle of 100°. The angle D with the bottom wall 91 of the trough 90 is an obtuse angle between 90° and 105°, such as an angle of 100°. The angle of the rear wall 93 provides increased room behind the rear wall 93 for mounting of components that require more space than would be provided by a vertical rear wall 93. For example, in one embodiment, the angle of the rear wall 93 provides from 1-2 inches of additional space (measured relative to a virtual vertical wall) at the bottom wall 91, e.g., 1.5 inch in the embodiment of FIGS. 1-11. As shown in FIG. 7, a large capacity soap supply 41 is shown mounted behind the rear wall 93, which is possible due to the increased space provided by the angled rear wall 93. In another embodiment, the rear wall 93 may be vertical or substantially vertical.

The basin assembly 11 has a drain 17 for drainage of water from the basin assembly 11. A drain pipe 19 (shown virtually in FIG. 7) is connected to the drain 17 and extends away from the drain 17. The drain pipe 19 may include a trap (not shown) as known in the art. The drain 17 in the embodiment of FIGS. 1-11 extends through the front wall 82 of the trough 90 and is formed by a plurality of slots 83 through the front wall 82, rather than through the bottom 91 of the trough 90. The slots 83 form a grate to prevent large objects from passing through the drain 17.

The water dispenser 30 in the embodiment of FIGS. 1-11 includes at least a water outlet 31 in the form of a water spout mounted on the basin assembly 11, and a water supply line or inlet conduit (not shown) connecting the water outlet 31 to a water supply that may include both a hot water line and a cold water line (not shown) in one embodiment. The water dispenser 30 may also have an actuator (not shown) configured to activate the water dispenser 30 to dispense water, such as by opening one or more valves. The water dispenser 30 may include manual and/or automatic actuators, and in the embodiment of FIGS. 1-11, the actuator function of the water dispenser 30 is provided electronically, e.g., by a control unit (not shown). The water dispenser 30 may include one or more sensors to detect a user's hands, such as a time-of-flight (TOF) or other proximity sensor, and the control unit may receive input from such a sensor and actuate the water dispenser 30 accordingly. In the case of a hand washing station 10 with multiple water outlets 31, the water dispenser may have different control units or other actuators associated with each water outlet 31 individually or a single control unit or other actuator associated with all water outlets 31. In another embodiment, the water dispenser 30 may further include a water heater for selectively heating water directed to one or more water outlets 31.

The water outlet 31 forms an outlet of the water dispenser 30 and directs water into the basin assembly 11 of the hand washing station 10 to wet the hands of a user. The water outlet 31 may include one or more nozzles in one embodiment that are configured to spray water downward into the basin assembly 11, although the water outlet 31 may take another form in other embodiments. The water outlet 31 is generally positioned above the basin assembly 11 and directed generally downward toward the basin assembly 11 in the embodiment of FIGS. 1-11.

The soap dispenser 40 generally includes a soap supply 41, a soap outlet 42 in the form of a soap spout mounted on the basin assembly 11. The soap dispenser 40 may also include an actuator configured to be actuated by a user to cause the soap dispenser 40 to dispense soap. The soap dispenser 40 may include manual and/or automatic actuators, and in the embodiment of FIGS. 1-11, the actuator function of the soap dispenser 40 is provided electronically by a control unit (not shown) and a soap pump (not shown). The actuator of the soap dispenser 40 may include components and functionality discussed herein with respect to the water dispenser 30. An example of the soap supply 41 is shown in FIG. 7 in the form of a detachable and replaceable bottle.

The hand dryer 60 generally includes a blower motor (not shown) configured to heat air and force the heated air to an air output 62 through a conduit (not shown) that extends between the blower motor and the air output 62. The motor 61 may have a heater element (not shown) to heat the air. The air output 62 is in the form of an air spout mounted on the basin assembly 11, which is positioned above and directed downward into the basin 35 in the embodiment of FIGS. 1-11. The basin assembly 11 may have contours and surfaces configured to deflect and/or direct the airflow of the hand dryer 60 away from the user as described herein. In other embodiments, the hand washing station 10 may include multiple hand dryers 60 that may include multiple air outputs 62 and one or more blower motors. The hand dryer 60 may further include an actuator (not shown) configured to be actuated by a user to cause the hand dryer 60 to blow air from the air output 62. The hand dryer 60 may include manual and/or automatic actuators, and in the embodiment of FIGS. 1-11, the actuator function of the hand dryer 60 is provided electronically by a control unit. The actuator of the hand dryer 60 may include components and functionality discussed herein with respect to the water dispenser 30.

In another embodiment, a hand washing station 10 may be provided including a basin assembly 11 having the same or similar surface contours with a greater lateral width to accommodate multiple water dispensers 30, soap dispensers 40, and/or hand dryers 60. It is understood that a hand washing station 10 may include multiple sets of a water dispenser 30, a soap dispenser 40, and a hand dryer 60. When multiple such components are used, the multiple water dispensers 30, soap dispensers 40, and/or hand dryers 60 may share components such as a single soap supply 41, a single blower motor 61, and/or a single control unit. In a further embodiment, the hand washing station 10 may be a modular component designed for seamless installation contiguous with other restroom components.

Figure 12:
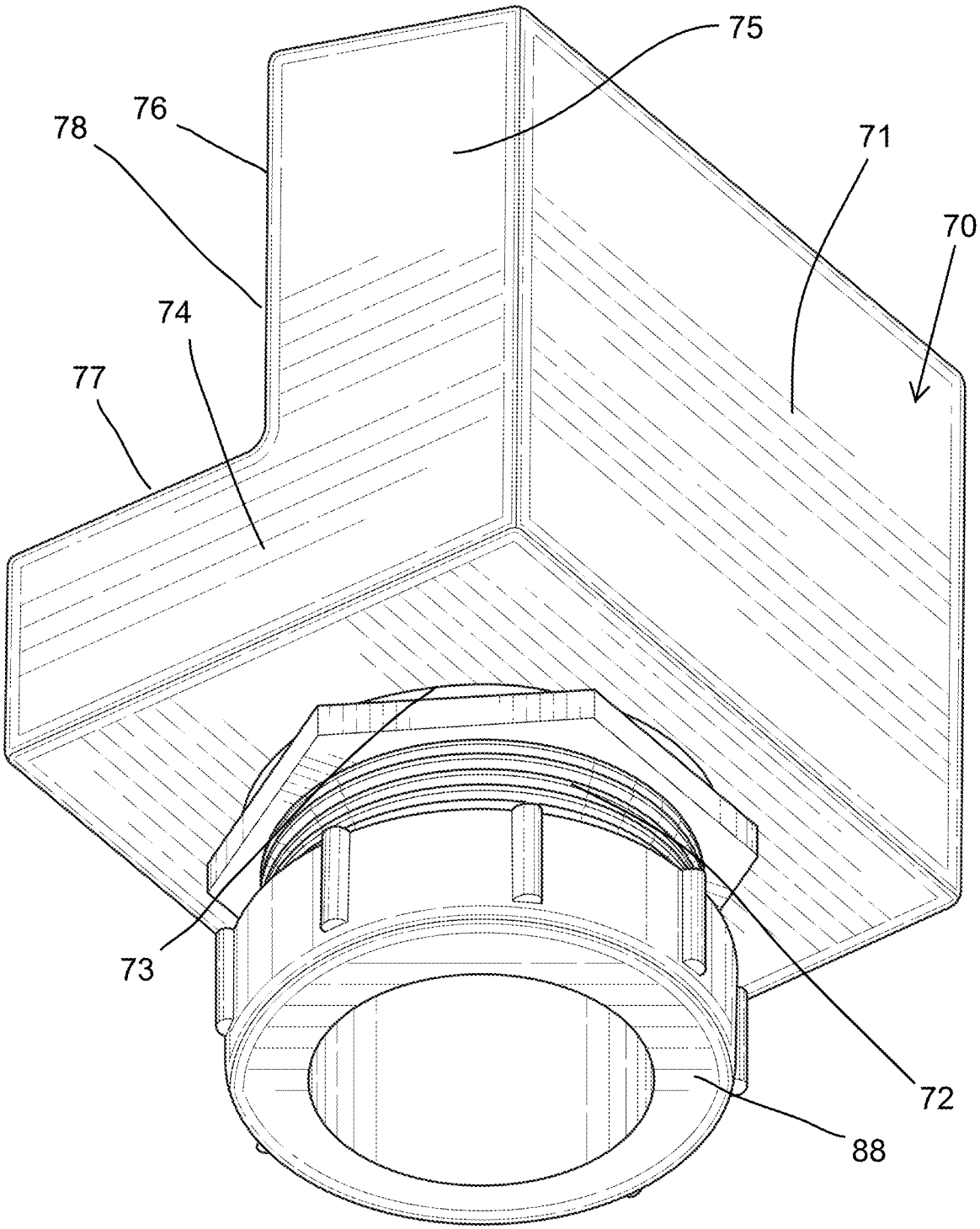
FIG. 12 is a bottom perspective view of one embodiment of a drain adapter assembly usable with the hand washing station of FIG. 1.
Figure 13:
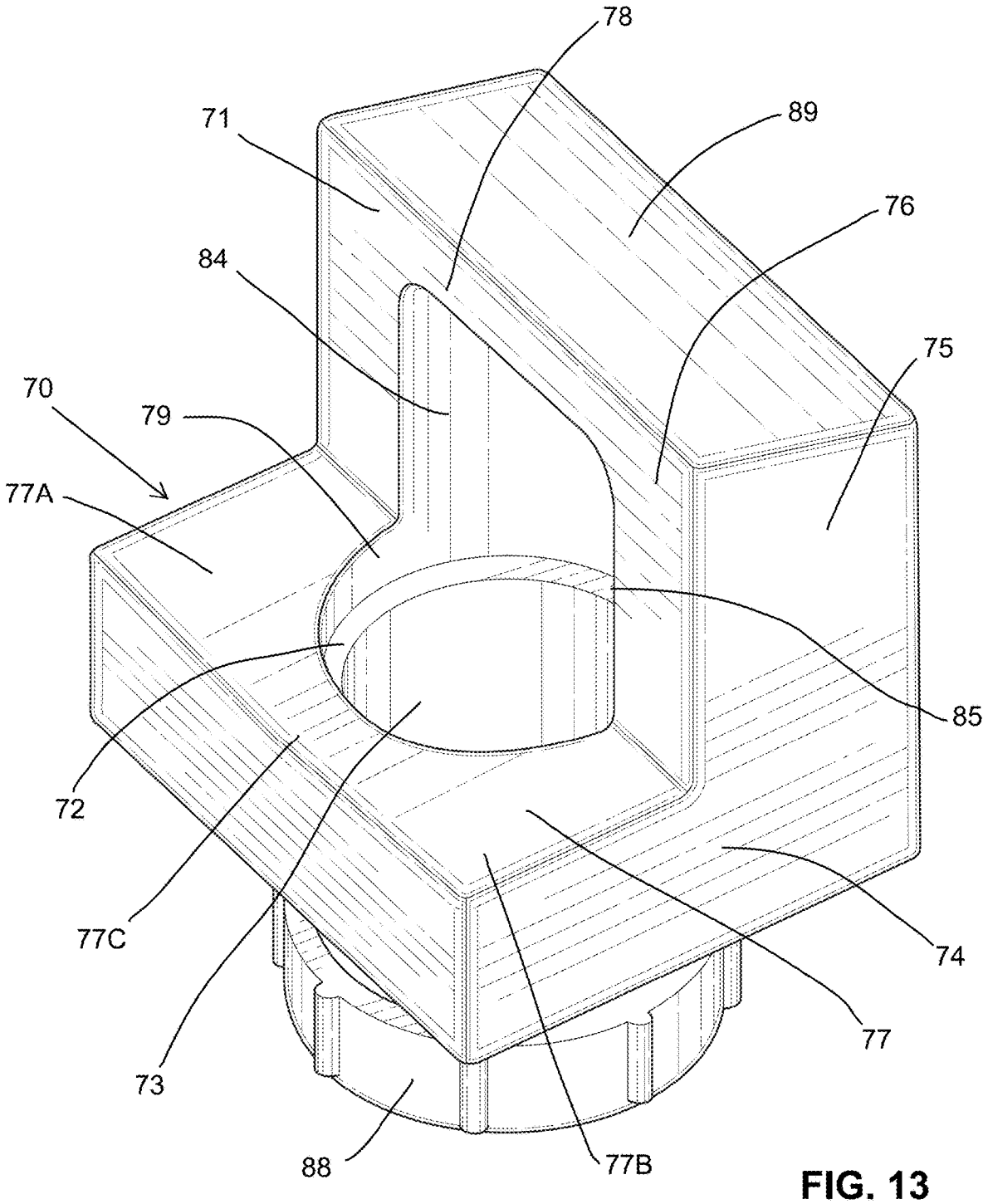
FIG. 13 is a top perspective view of the drain adapter assembly of FIG. 12.
Figure 14:
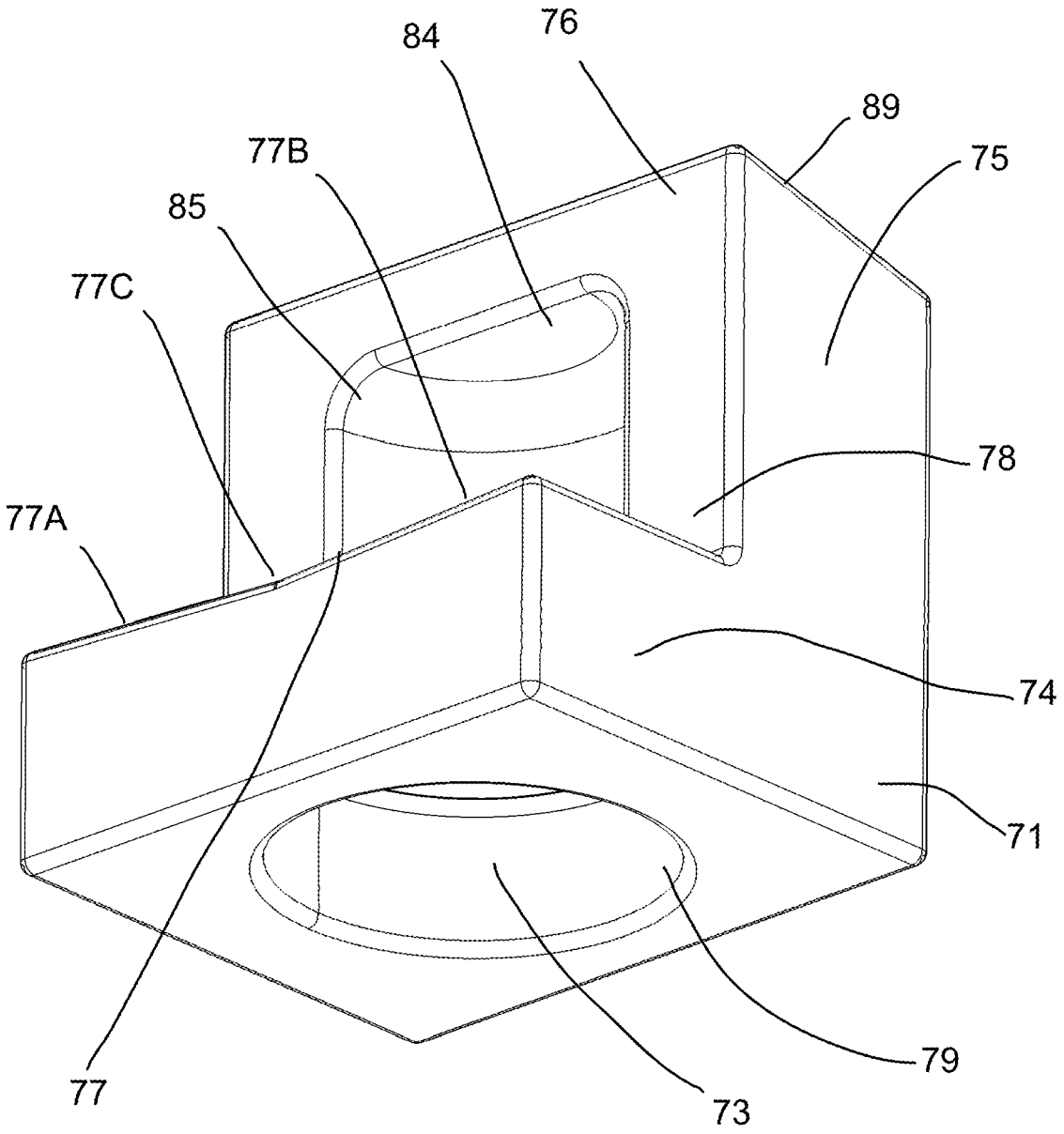
FIG. 14 is a bottom perspective view of a drain adapter of the drain adapter assembly of FIG. 12.

The hand washing station 10 of FIGS. 1-11 includes a drain adapter assembly 70 connected to the basin assembly 11 at the location of the drain 17, including a drain adapter 71 and a drain pipe connector 72 connected to an outlet 73 of the drain adapter 71, as illustrated in more detail in FIGS. 12-14. The drain adapter 71 has a base 74 and an arm 75 extending upward from the base 74 to define a substantially L-shaped profile. In this configuration, the drain adapter 71 has a cut-out 78 defined by a vertical engagement surface 76 on the arm 75 and a horizontal engagement surface 77 on the base 74. The drain adapter 71 engages the underside surface of the trough 90 around the drain 17 such that the bottom wall 91 of the trough 90 engages the horizontal engagement surface 77, the front wall 82 of the trough 90 engages the vertical engagement surface 76, and a portion of the trough 90 around the drain 17 is received within the cut-out 78. The vertical and horizontal engagement surfaces 76, 77 of the drain adapter 71 may be oriented at the same angle to each other as the front wall 82 and the bottom wall 91 of the trough 90, which is approximately 90° in the embodiment of FIGS. 1-14. The base 74 of the drain adapter 71 has a circular passage 79 extending vertically through the base 74 and through the horizontal engagement surface 77, and the arm 75 has a recess 84 extending into the vertical engagement surface 76, which is in communication with the passage 79. The recess 84 and the passage 79 form a contiguous opening in the drain adapter 71 that is in communication with the cut-out 78, which functions as an inlet 85 of the drain adapter 71. The recess 84 in the embodiment of FIGS. 1-14 is large enough that the entire drain 17 (i.e., the entireties of all the slots 83) are in communication with the recess 84 and the passage 79. The liquid that exits the trough 90 through the drain 17 enters the recess 84 and is directed downward into the passage 79.

The passage 79 is configured for connection to the drain pipe 19 to remove the liquid that flows through the drain 17, and the passage 79 thereby functions as the outlet 73 of the drain adapter 71. In the embodiment of FIGS. 1-14, the drain adapter assembly 70 includes a drain pipe connector 72 having an upper portion 86 received in the passage 79 and/or the outlet 73 to receive liquid from the passage 79, and a connection portion 87 located below the upper portion 86 and configured for connection to the drain pipe 19. The connection portion 87 may include a threaded nut 88 for connection to the drain pipe 19.

Figure 5:
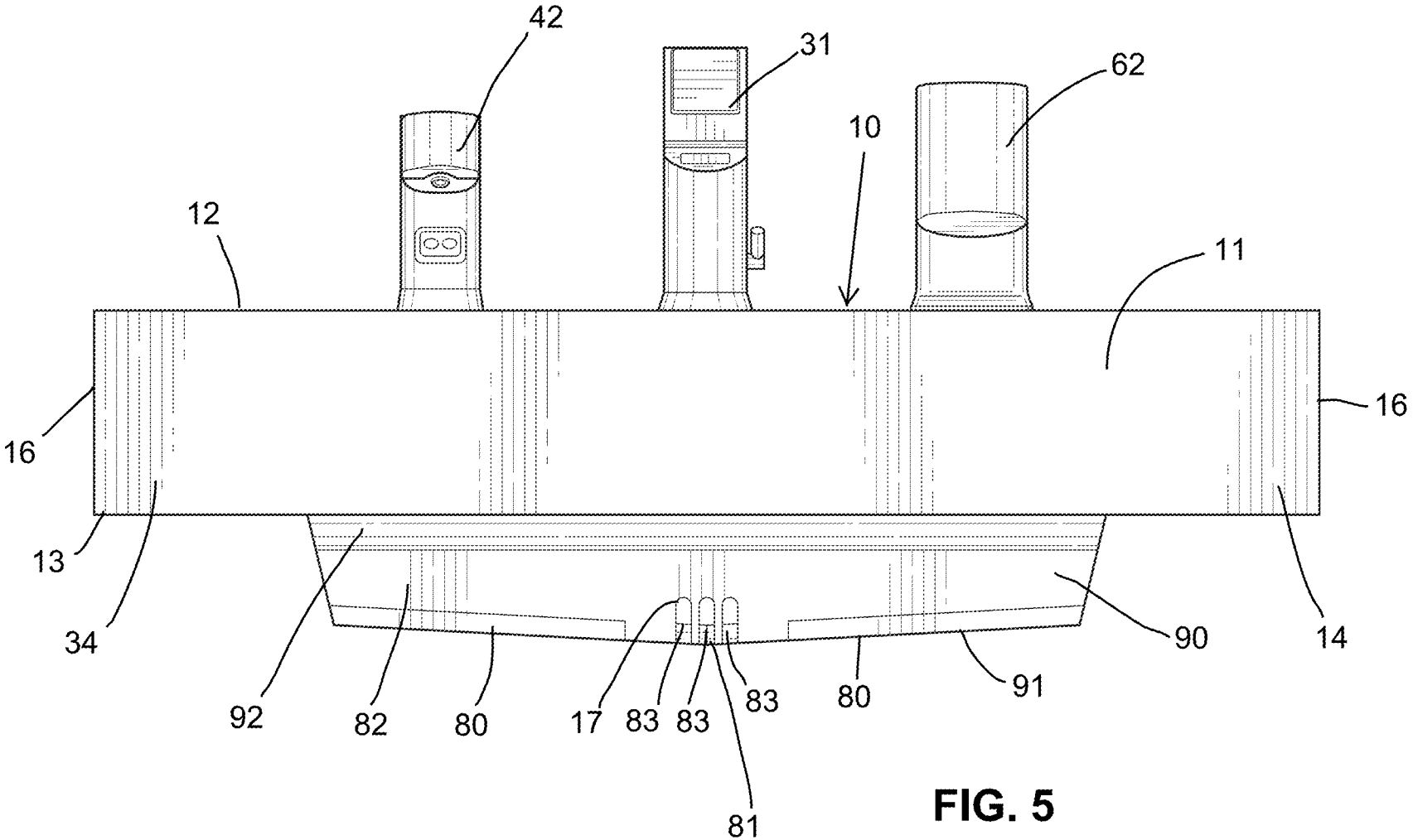
FIG. 5 is a front view of the hand washing station of FIG. 1.
Figure 6:
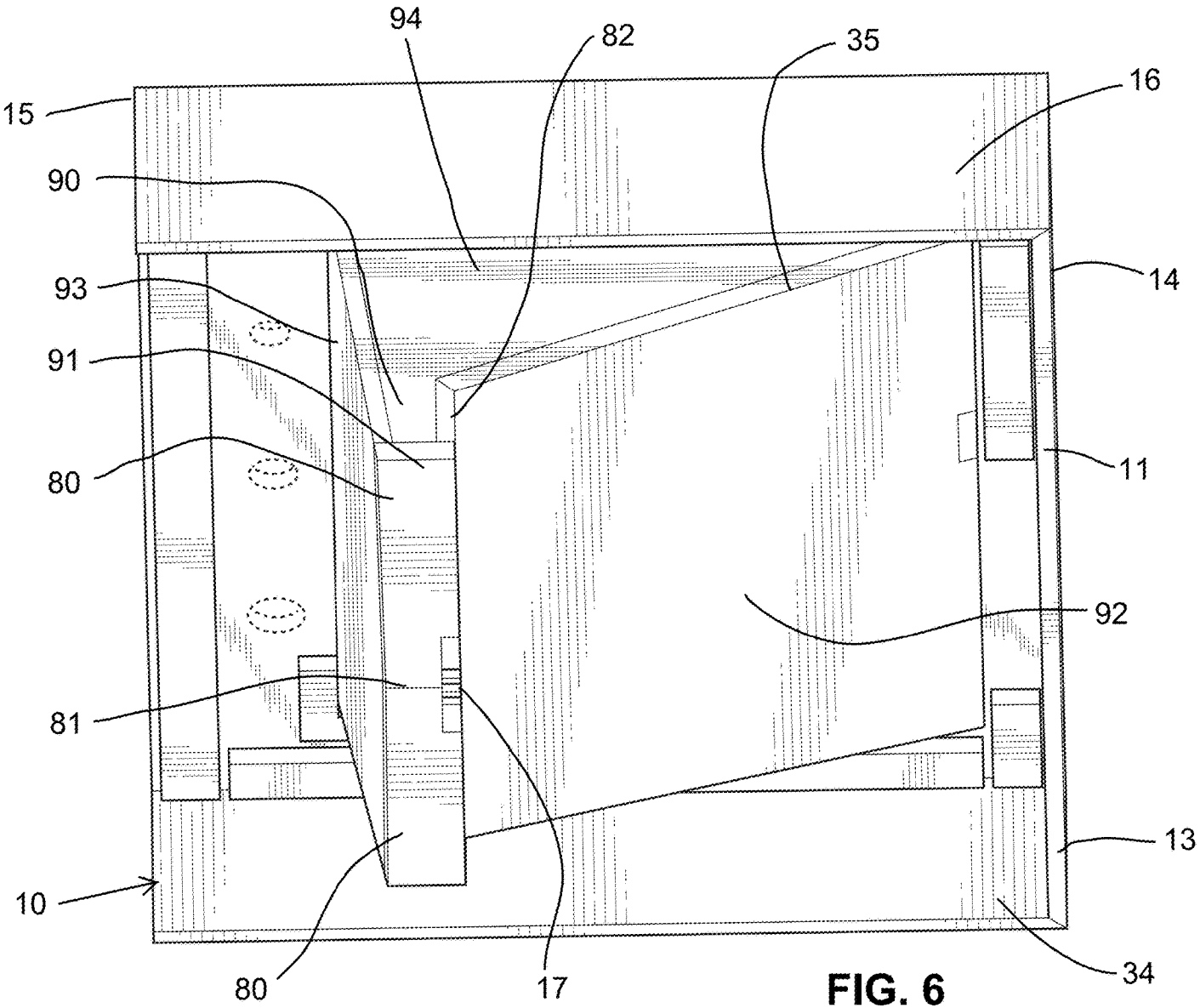
FIG. 6 is a bottom perspective view of the hand washing station of FIG. 1.

The drain adapter assembly 70 is connected to the underside of the basin 35 by bonding using an adhesive or other bonding material in one embodiment. In this configuration, the vertical engagement surface 76 is bonded to the front wall 82 of the trough 90 around the drain 17, and the horizontal engagement surface 77 is bonded to the bottom wall 91 of the trough 90 below the drain 17 and around the passage 79. The bottom wall 91 of the trough 90 has a peak 81 at the lowermost point, forming a slight V-shape when viewed along the longitudinal direction, as seen in FIGS. 5 and 9. The horizontal engagement surface 77 has an indented shape to match the V-shape of the bottom wall 91 of the trough 90. In other words, the horizontal engagement surface 77 in this embodiment has two planar surfaces 77A, 77B that are positioned at a large oblique angle to each other, e.g., 170-175° in one embodiment. The two surfaces 77A, 77B meet each other along a junction line 77C that runs along the lateral center plane of the drain adapter 71. The horizontal engagement surface 77 is engaged with the trough 90 in the embodiment of FIGS. 1-14, such that the two sections 80 of the bottom wall 91 are engaged with the two surfaces 77A, 77B, and the junction line 77C is engaged with the peak 81 of the trough 90. The top 89 of the drain adapter 71 is also angled relative to the horizontal engagement surface 77, and extends downward and away from the vertical engagement surface 76 on the top of the arm 75. The connection of the drain adapter 71 to the basin 35 provides increased connection strength, due to bonding to both vertical and horizontal surfaces of the basin 35. Additionally, the drain adapter 71 may be made from a similar material as the adjacent surfaces of the basin 35, e.g., Corian, which improves bonding strength by permitting the use of an adhesive specifically designed for bonding with the particular material. Further, the configuration of the drain adapter lowers the profile of the drain connection, reducing space by approximately 1.5" to 2", without reducing the flow rate from the drain 17.

In another embodiment, the drain 17 may extend through the rear wall 93, and the drain adapter 71 may be engaged with and connected to the rear wall 93 and the bottom wall 91 of the trough 90, with the understanding that the angle between the vertical and horizontal engagement surfaces 76, 77 may be different. In a further embodiment, the drain adapter 71 may be configured for connection to a drain 17 that extends partially or entirely through the bottom wall 91 of the trough 90, such as having an enlarged base 74 with an enlarged opening around the passage 79 to receive water from the entire drain 17.

The drain adapter 71 permits improved cleaning access for the drain 17 relative to existing drain configurations that use horizontal pipes. The drain adapter 71 permits a person servicing the drain 17 to access the drain 17 directly vertically through the passage 79, avoiding the need for a cleaning instrument to extend around a corner or bend to access the drain 17. Further, a clean-out may be performed by drilling a hole 96 through the arm 75 to the recess 84 to access the drain 17 without removing the drain pipe 19, as illustrated schematically in FIG. 10. This hole 96 may later be plugged.

Various embodiments of hand washing stations have been described herein, which include various components and features. In other embodiments, the hand washing stations may be provided with any combination of such components and features. It is also understood that in other embodiments, the various devices, components, and features of the hand washing stations described herein may be constructed with similar structural and functional elements having different configurations, including different ornamental appearances.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "top," "bottom," "front," "back," "side," "rear," "proximal," "distal," and the like, as used herein, are intended for illustrative purposes only and do not limit the embodiments in any way. Nothing in this specification should be construed as requiring a specific three dimensional orientation of structures in order to fall within the scope of this invention, unless explicitly specified by the claims. When used in description of a method or process, the term "providing" (or variations thereof) as used herein means generally making an article available for further actions, and does not imply that the entity "providing" the article manufactured, assembled, or otherwise produced the article. The term "approximately" as used herein implies a variation of up to 10% of the nominal value modified by such term, or up to 10% of a midpoint value of a range modified by such term. "Integral joining technique," as used herein, means a technique for joining two pieces so that the two pieces effectively become a single, integral piece, including, but not limited to, irreversible joining techniques such as welding, brazing, soldering, or the like, where separation of the joined pieces cannot be accomplished without structural damage thereto. Additionally, the term "plurality," as used herein, indicates any number greater than one, either disjunctively or conjunctively, as necessary, up to an infinite number. Accordingly, while the specific embodiments have been illustrated and described, numerous modifications come to mind without significantly departing from the spirit of the invention and the scope of protection is only limited by the scope of the accompanying claims.

What is claimed is:

1. A hand washing station comprising:

a basin assembly having a rear configured for mounting to a wall surface and a front opposite the rear, the basin assembly comprising a shelf extending across the front of the basin assembly at a top of the basin assembly and a basin extending below the shelf having a front sloping surface having a front end located proximate to the front and the top of the basin assembly and extending rearward and downward from the front end to a rear end, a trough located at the rear end of the front sloping surface, and a rear wall extending upward from the trough to the rear and the top of the basin assembly, wherein the trough comprises a front wall extending downward from the rear end of the front sloping surface and a bottom wall extending rearward from the front wall, the basin assembly further comprising a drain within the trough formed by a slot extending through the front wall; and a drain adapter mounted on an outer surface of the front wall of the trough below the basin, the drain adapter having a recess in communication with the drain and a passage extending from the recess through the drain adapter to an outlet configured for connection to a drain pipe, wherein the drain adapter is configured to receive water exiting the basin through the drain into the recess and to output the water to the drain pipe.

2. The hand washing station of claim 1, wherein the basin has two opposed side walls extending downward on opposite sides of the basin assembly and intersecting with the rear wall, the trough, and the front sloping surface, and wherein the trough extends an entire width of the basin between the opposed side walls.

3. The hand washing station of claim 1, wherein the rear wall is a planar wall extending from the top of the basin assembly to the bottom wall of the trough.

4. The hand washing station of claim 1, wherein the shelf further extends around an entire periphery of the basin, along opposed sides of the basin assembly and along the rear of the basin assembly.

5. The hand washing station of claim 4, further comprising a water dispenser having a water spout mounted on the shelf at the rear of the basin assembly and configured to dispense water through the water spout into the basin.

6. The hand washing station of claim 5, further comprising:

a soap dispenser having a soap spout mounted on the shelf at the rear of the basin assembly and configured to dispense soap through the soap spout;

a hand dryer having an air spout mounted on the shelf at the rear of the basin assembly and configured to force heated air through the air spout.

7. The hand washing station of claim 1, wherein the drain adapter further comprises a base engaged with the bottom wall of the trough and extending rearward along an outer surface of the bottom wall, and an arm engaged with the front wall of the trough and extending upward from the base along the outer surface of the front wall.

8. The hand washing station of claim 7, wherein the recess of the drain adapter is defined in the arm and the base, and the passage extends from the recess through the base of the drain adapter to the outlet.

9. The hand washing station of claim 1, wherein the drain is located between opposed ends of the trough, and the bottom wall of the trough is sloped downward and toward the drain from both of the opposed ends.

10. The hand washing station of claim 1, further comprising a hand dryer configured to force heated air into the basin, and the basin assembly further comprises a vent located between the front end of the front sloping surface and the shelf, wherein the front sloping surface is configured to direct the heated air into the vent.

11. A hand washing station comprising:

a basin assembly having a rear configured for mounting to a wall surface and a front opposite the rear, the basin assembly comprising a basin having a trough positioned proximate to the rear of the basin assembly and recessed from an adjacent surface of the basin located forward of the trough, wherein the trough comprises a front wall extending downward from the adjacent surface and a bottom wall extending rearward from the front wall, the basin assembly further comprising a drain within the trough formed by a slot extending through the front wall; and a drain adapter mounted on the trough and engaged with outer surfaces of the front wall and the bottom wall of the trough below the basin, the drain adapter comprising a base and an arm extending upward from the base, the base having a horizontal engagement surface engaged with the bottom wall of the trough and extending rearward along the outer surface of the bottom wall, and the arm having a vertical engagement surface engaged with the front wall of the trough and extending upward along the outer surface of the front wall, the drain adapter having a recess defined in the horizontal engagement surface and the vertical engagement surface and a passage extending from the recess through the drain adapter to an outlet configured for connection to a drain pipe, wherein the drain adapter is mounted to place the recess in communication with the drain, such that the recess is configured to receive water exiting the basin through the drain and to output the water to the drain pipe.

12. The hand washing station of claim 11, wherein the basin has two opposed side walls extending downward on opposite sides of the basin, and wherein the trough extends an entire width of the basin between the opposed side walls.

13. The hand washing station of claim 11, wherein the basin further has a rear wall having a sloped, planar surface extending from a top of the basin assembly to the bottom wall of the trough.

14. The hand washing station of claim 11, the basin assembly further comprises a shelf at the top of the basin assembly and extending around an entire periphery of the basin, along the front and the rear of the basin assembly and along opposed sides of the basin assembly, wherein the basin extends below the shelf.

15. The hand washing station of claim 14, further comprising:

a water dispenser having a water spout mounted on the shelf at the rear of the basin assembly and configured to dispense water through the water spout into the basin;

a soap dispenser having a soap spout mounted on the shelf at the rear of the basin assembly and configured to dispense soap through the soap spout; and a hand dryer having an air spout mounted on the shelf at the rear of the basin assembly and configured to force heated air through the air spout.

16. The hand washing station of claim 1, wherein the drain is located between opposed ends of the trough, and the bottom wall of the trough is sloped downward and toward the drain from both of the opposed ends.

17. A hand washing station comprising:

a basin assembly having a rear configured for mounting to a wall surface and a front opposite the rear, the basin assembly comprising a front shelf extending across the front of the basin assembly at a top of the basin assembly, a rear shelf extending across the rear of the basin assembly at the top of the basin assembly, and a basin extending below the front shelf and the rear shelf and having a trough positioned proximate to the rear of the basin assembly and recessed from an adjacent surface of the basin located forward of the trough, wherein the trough comprises a front wall extending downward from the adjacent surface and a bottom wall extending rearward from the front wall, the basin assembly further comprising a drain within the trough formed by a slot extending through the front wall;

a water dispenser having a water spout mounted on the rear shelf and configured to dispense water through the water spout into the basin;

a soap dispenser having a soap spout mounted on the rear shelf and configured to dispense soap through the soap spout;

a hand dryer having an air spout mounted on the rear shelf and configured to force heated air through the air spout; and a drain adapter mounted on an outer surface of the front wall of the trough below the basin, the drain adapter including a passage in communication with the drain and extending through the drain adapter to an outlet configured for connection to a drain pipe, wherein the drain adapter is configured to receive water exiting the basin through the drain and to output the water to the drain pipe.

18. The hand washing station of claim 17, the basin assembly further comprising a vent located below the shelf at the front of the basin assembly, wherein the basin has an inclined surface configured to direct the heated air into the vent.

19. The hand washing station of claim 17, wherein the basin has two opposed side walls extending downward on opposite sides of the basin assembly and intersecting with the trough, and wherein the trough extends an entire width of the basin between the opposed side walls.

20. The hand washing station of claim 17, wherein the basin further has a rear wall having a sloped, planar surface extending from the rear shelf to the bottom wall of the trough.

21. The hand washing station of claim 17, wherein the drain adapter further comprises a base engaged with the bottom wall of the trough and extending rearward along an outer surface of the bottom wall, and an arm engaged with the front wall of the trough and extending upward from the base along the outer surface of the front wall.

22. The hand washing station of claim 21, wherein the drain adapter has a recess defined in at least the arm and a passage extending from the recess through the drain adapter to an outlet configured for connection to a drain pipe, wherein the drain adapter is mounted to place the recess in communication with the drain, such that the recess is configured to receive the water exiting the basin through the drain and to output the water to the drain pipe.

23. The hand washing station of claim 17, wherein the drain is located between opposed ends of the trough, and the bottom wall of the trough is sloped downward and toward the drain from both of the opposed ends.

* * * * *